US005096414A

United States Patent [19]

Zellweger

[11] Patent Number: 5,096,414

[45] Date of Patent: Mar. 17, 1992

[54] CIGARETTE LIGHTER

[75] Inventor: Conrad Zellweger, Chene-Bougeries, Switzerland

[73] Assignee: Parnat S.A., Geneva, Switzerland

[21] Appl. No.: 600,991

[22] Filed: Oct. 23, 1990

Related U.S. Application Data

[63] Continuation of Ser. No. 399,985, Aug. 29, 1989, abandoned.

[30] Foreign Application Priority Data

Sep. 16, 1988 [CH] Switzerland ..... 03467/88

[51] Int. Cl.[5] ..... F23Q 1/02; F23Q 1/06

[52] U.S. Cl. ..... 431/277; 431/153; 431/273

[58] Field of Search ..... 431/153, 274, 276, 277, 431/273, 267

[56] References Cited

U.S. PATENT DOCUMENTS

| | | | |
|---|---|---|---|
| 2,498,377 | 2/1950 | Nissen | 431/274 |
| 2,544,249 | 3/1951 | Baystons | 431/273 |
| 3,063,276 | 11/1962 | Cassan | 431/277 X |
| 3,122,907 | 3/1964 | Gilberton | 431/277 X |
| 3,963,412 | 6/1976 | Chernock | 431/273 |

*Primary Examiner*—Carl D. Price

*Attorney, Agent, or Firm*—Young & Thompson

[57] ABSTRACT

The ignition device of the lighter comprises a striker wheel (6) acting on a spark stone (2). The striker wheel is disposed between two plates (7) and (8) of greater diameter than and freely rotatable with respect to the wheel. Actuation of this latter is obtained by friction thanks to the deformation (11) of the pulp of the thumb (10) of the user, and may not be driven by a child as the pulp of the finger of children is not sufficiently thick.

5 Claims, 1 Drawing Sheet

CIGARETTE LIGHTER

This application is a continuation of application Ser. No. 07/399,985, filed Aug. 29, 1989, now abandoned.

BACKGROUND OF THE INVENTION

Swiss patent No. 288,519 describes a lighter of the type having an ignition cover, which cover drives the striker wheel when it is opened. The cover of this lighter is retained in closed position by a clasp which must be subjected to two different movements to free the cover. This type of lighter is now practically abandoned, in favor of lighters in which a manually actuated element acts directly on the lighting device.

On the other hand, it is known that small children love to play with cigarette lighters, but that this may result in burns or even fires. The present invention has as an object to decrease these risks in large measure, by making the lighting of a lighter more difficult for children.

SUMMARY OF THE INVENTION

To this end, the invention has as an object a cigarette lighter, comprising a fuel well, a burner, a manually actuated igniting device, and an actuating element acting on the igniting device and/or on the fuel supply to the burner, characterized in that the actuating element is disposed between two projecting portions preventing this element from being reached by the finger of a child, but permitting it to be actuated by the finger of an adult thanks to deformation of the pulp of the finger.

The accompanying drawing depicts schematically and by way of example two embodiments of the lighter forming the object of the invention.

DESCRIPTION OF THE PREFERRED EMBODIMENT

Figure 1:
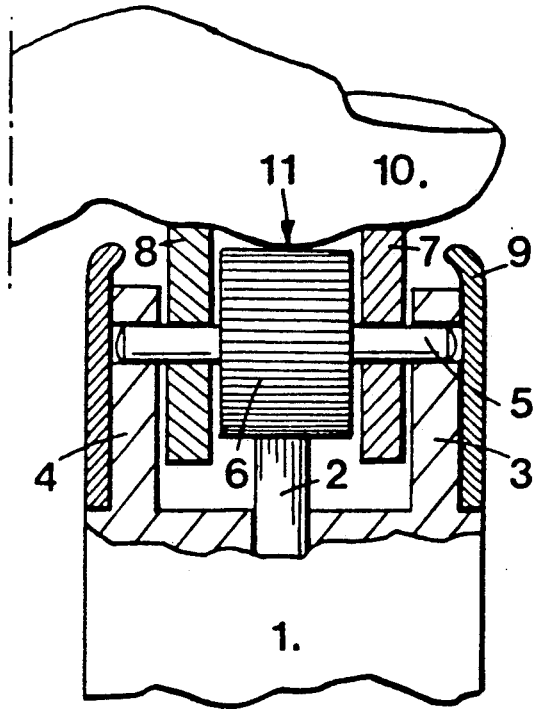
FIG. 1 is a sectional view of a part of the lighter according to the first embodiment.

Referring to FIG. 1, the lighter comprises in a manner known per se a body 1 forming a well for liquefied gas and having an opening containing a spring and a flint 2. The well 1 is extended toward its top by two arms 3 and 4 each having a bore for accommodating a rod 5 serving as a pivot pin for a striker wheel 6. This wheel is disposed between two plates 7 and 8 mounted on the same pin 5 as the wheel 6. A metallic flame guard 9 surrounds the arms 3 and 4 and confines the pin 5 against any axial displacement.

The plates 7 and 8 are freely rotatably mounted on the pin 5, and thus cannot cause rotation of the wheel 6. The height of the plates 7 and 8 above the flame guard 9 is greater than that of the wheel 6, because their diameter is greater than that of the wheel.

When an adult wishes to light the lighter, he places his thumb 10 on the two plates 7 and 8, and a portion 11 of the pulp of his thumb is deformed and comes into contact with the wheel 6, thereby permitting actuation of this wheel by the ordinary movement which causes lighting of this type of lighter.

On the contrary, the fingers of children have much less pulp than the fingers of adults, the pulp being the fleshy tissue at the end of the finger. Consequently, if a child effects the same manipulation as an adult, the pulp of his finger will not deform to the same extent and will not come into contact with the wheel 6. All that would thus happen would be that the plates 7 and 8 will be caused to turn without producing any spark capable of lighting the lighter.

It is evident that the absence of mechanical connection between the plates 7 and 8 and the wheel 6 may be obtained by freely mounting on the pin 5 either the plates 7 and 8 or the wheel 6, or all of these elements.

In a conventional lighter construction, the striker wheel is constituted by a hub on which a toothed metallic wire is helically wound. In such case the wound wire may be mounted such that it is freely rotatable on the hub, which is fixed with the plates 7 and 8.

Figure 2:
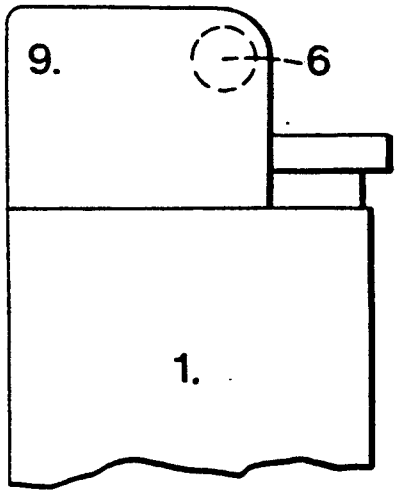
FIG. 2 is a partial side view of the second embodiment.
Figure 3:
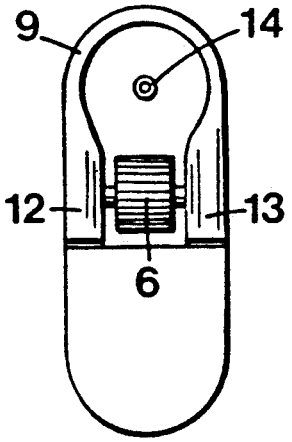
FIG. 3 is a plan view of this second embodiment.

In the second embodiment illustrated in FIGS. 2 and 3, the lighter comprises a flame guard 9 as previously described, but the height of this latter is greater than that of the striker wheel 6 and the two edges 12 and 13 of this flame guard are formed so as to come into the immediate proximity of the wheel 6. The flame guard 9 surrounds, in a known manner, a burner 14 for the outlet of gas. The same phenomenon is employed in this second embodiment as in the preceding, namely, the pulp of the finger of an adult may come into contact with the wheel 6, whereas the pulp of the finger of a child does not reach there.

It is evident that the arrangement forming the object of the invention may be applied to lighters in which the ignition device is not of the type having a striker wheel and spark stone, but for example of the piezoelectric type whose actuating member would then be engaged between two projecting portions for preventing a child from reaching it.

What is claimed is:

1. Cigarette lighter, comprising a fuel well, a burner, a manually actuated ignition device including a rotatable actuating member having a toothed periphery acting on a flint, characterized in that the actuating member is disposed between two portions projecting radially beyond said actuating member, said actuating member being rotatable relative to said projecting portions, said toothed periphery being adapted to be contacted by the finger of a user to rotate the actuating member to ignite the burner, said toothed periphery being free from contact with any portion of said lighter other than said flint and being disposed at least midway between said projecting portions.

2. Lighter according to claim 1 in which the actuating member is a rotatable striker wheel, characterized in that this striker wheel is disposed between two arms wheel height is greater than that of the wheel.

3. Lighter according to claim 2, characterized in that the arms are fixed and are constituted by a portion of the body or the housing of the lighter.

4. Lighter according to claim 1, wherein said toothed periphery extends most of the way between said projecting portions.

5. Cigarette lighter, comprising a fuel well, a burner, a manually actuated ignition device including a rotatable actuating member acting on a flint, characterized in that the actuating member is disposed between two portions projecting radially beyond said actuating member, said actuating member being rotatable relative to said projecting portions and having a peripheral surface adapted to be contacted by the finger of a user to rotate the actuating member to ignite the burner, said periphery surface being free from contact with any portion of said lighter other than said flint, said projecting portions comprising discs carried by a stud on which said actuating member is mounted, these discs having a diameter greater than that of the actuating member and being freely rotatable relative to said actuating member.

* * * * *